US005505371A

United States Patent [19]

O'Neill

[11] Patent Number: 5,505,371

[45] Date of Patent: Apr. 9, 1996

[54] SHIPPING AND DISPLAY CARTON WITH PARTITION

[75] Inventor: Jeffrey S. O'Neill, Baltimore, Md.

[73] Assignee: Westvaco Corporation, New York, N.Y.

[21] Appl. No.: 493,941

[22] Filed: Jun. 23, 1995

[51] Int. Cl.[6] ..... B65D 5/496

[52] U.S. Cl. ..... 229/120.26; 229/120.24; 229/162; 229/242; 206/45.31

[58] Field of Search ..... 229/120.24, 120.26, 229/162, 242; 206/45.31, 45.34

[56] References Cited

U.S. PATENT DOCUMENTS

| | | | |
|---|---|---|---|
| 2,596,205 | 5/1952 | Buttery | 229/120.26 |
| 2,643,811 | 6/1953 | Bolding | 206/45.31 |
| 3,325,078 | 6/1967 | Bach | 229/120.26 |
| 3,682,297 | 8/1972 | Austin et al. | 206/45.31 |
| 3,829,006 | 8/1974 | Spiegel | 229/242 |
| 3,872,966 | 3/1975 | Gordon et al. | 206/45.31 |
| 4,320,867 | 3/1982 | Gardner | 229/42 |
| 4,335,842 | 6/1982 | Bradford et al. | 229/120.24 |
| 4,403,727 | 9/1983 | Grieve et al. | 229/162 |
| 4,482,055 | 11/1984 | Boyle | 229/120.26 |
| 5,167,324 | 12/1992 | Miller | 229/242 |
| 5,282,567 | 2/1994 | Dickson | 229/120.25 |

*Primary Examiner*—Gary E. Elkins

[57] ABSTRACT

A shipping and display carton includes an outer container and an inner partition structure. The partition structure is constructed from a single cut and scored blank of corrugated paperboard that is folded and erected to form a modified Z-type divider with three loading cells. The front wall of the outer container includes a perforated cut-out that is removed for display purposes, and each divider panel of the partition structure includes a cut-out that is compatible in size and shape with the cut-out in the front wall of the outer container.

10 Claims, 3 Drawing Sheets

SHIPPING AND DISPLAY CARTON WITH PARTITION

BACKGROUND OF INVENTION

Shipping cartons of the type disclosed in the present application are commonly employed both for shipping and display of a plurality of articles in a single carton. The articles may be of a wide variety but typically are household products such as liquid laundry soap, bleach or the like.

The use of the same carton for both shipping, and display at the point of sale, is particularly common both in warehouse clubs and in grocery stores where products are sold in bulk form. In such operations, it is conventional practice to package a plurality of articles in a single carton and then place a number of such cartons on a pallet for shipping and/or display.

When the articles to be shipped and displayed are relatively heavy, the cartons in which they are packaged must be constructed to have sufficient strength to withstand the rigors of shipping including stacking and storage. It is also preferable in such instances to provide partitions which keep the articles spaced from one another as much as possible, and, where the cartons are stacked or palletized, they must have sufficient structural rigidity to withstand stacking loads.

For these and other reasons such cartons used in the past have been designed to form a complete enclosure for the articles at least during shipping with full height and width partition elements to provide stacking strength.

Moreover, when such cartons reach the point of sale, they are generally provided with removable top closure flaps and panels to facilitate display of the articles within the cartons, and to permit their removal by consumers or the like as desired. In such an instance, the presence of full height, full width partition elements, which have been deemed necessary for shipping, tend to obscure some of the packaged articles when the shipping cartons are converted to display cartons.

As described above, the prior art cartons presently in use are costly to manufacture and difficult to set up for display. In addition, the partition elements presently in use are cumbersome to insert and difficult to remove. Accordingly, it is apparent from the above that there exists a need in the art for a carton capable of use in both the shipping and display of a plurality of articles. The carton should be more economical to manufacture than those presently in use, and it should be more user-friendly for converting from its shipping mode to its display mode without sacrificing stacking strength. The invention disclosed herein is believed to satisfy these needs.

SUMMARY OF INVENTION

It is an object of the present invention to provide a shipping and display carton which is simple in design to minimize cost and assembly, and furthermore, which provides adequate structural strength, particularly when a plurality of such filled cartons are stacked on shipping pallets or the like.

It is a further object of the present invention to provide such a shipping and display carton which is formed from essentially two elements, an outer container and an interior partition element.

It is still a further object of the present invention to provide in such a shipping and display carton an outer container wherein a portion of the front panel may be removed for display purposes, and an interior partition element with divider panels that include cut-outs which are generally of the same size and shape as the cut-out that is removed from the front panel of the outer container.

Other objects and advantages of the invention will become apparent from a consideration of the following detailed description having reference to the accompanying drawings.

DETAILED DESCRIPTION

Figure 4:
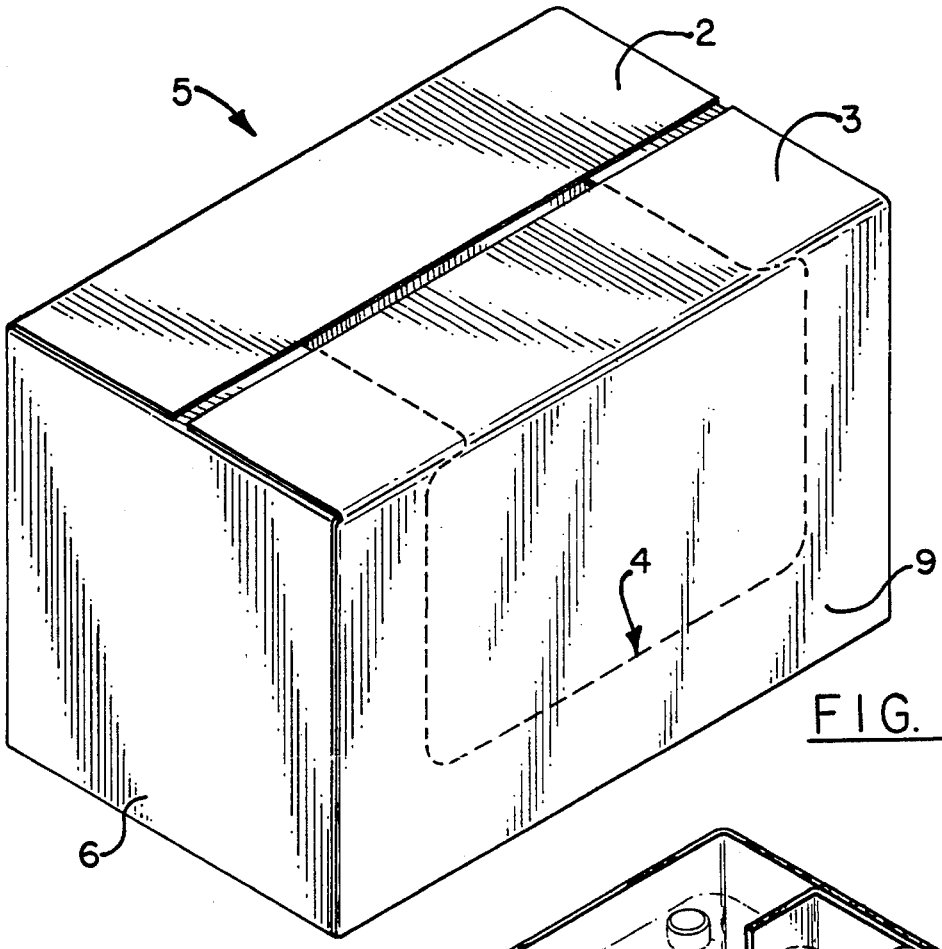
FIG. 4 is an isometric view of a filled carton in its shipping mode.
Figure 5:
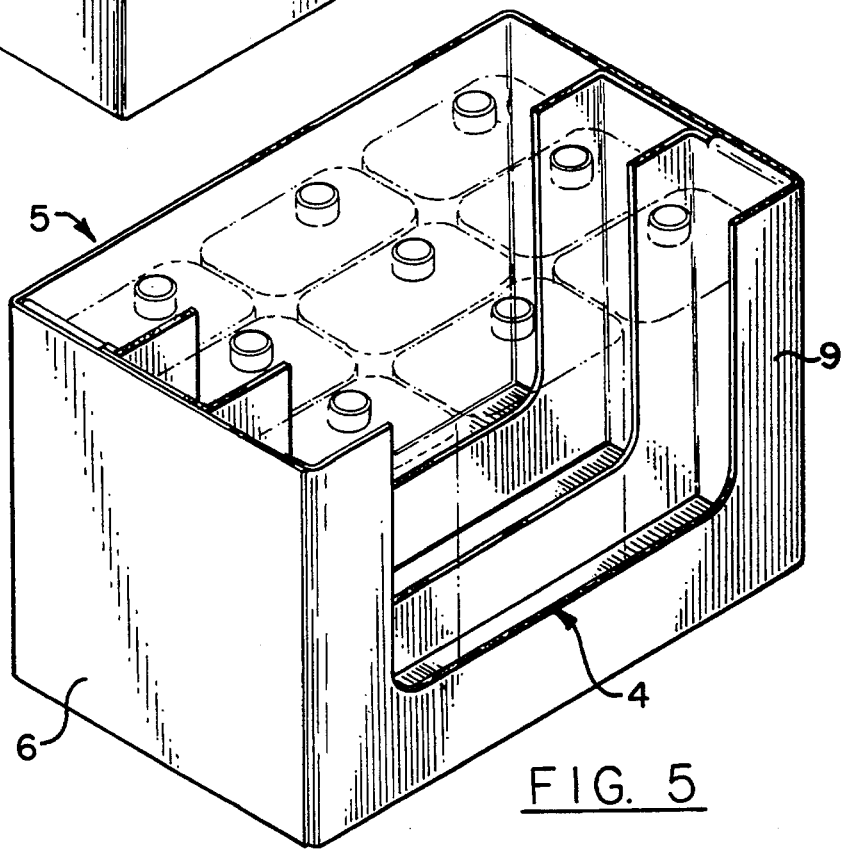
FIG. 5 is an isometric view of the carton of FIG. 4 in the display mode.

The outer container used in the shipping and display carton of the present invention is of conventional construction including a plurality of side wall panels all connected together, with top and bottom closure flaps foldably attached to the top and bottom ends of the side wall panels. Such cartons are generally made on a printer-slotter using conventional equipment and are shipped to the user in a preglued flattened condition. In the preferred construction, a portion of the front wall of the outer container, and part or all of the top closure flaps may be removed for display purposes as shown in FIG. 5. Meanwhile, all panels and flaps of the outer container are sealed and are intact for shipping purposes as shown in FIG. 4. An example of a combination shipping and display carton is shown for example in U.S. Pat. No. 5,282,567.

Figure 1:
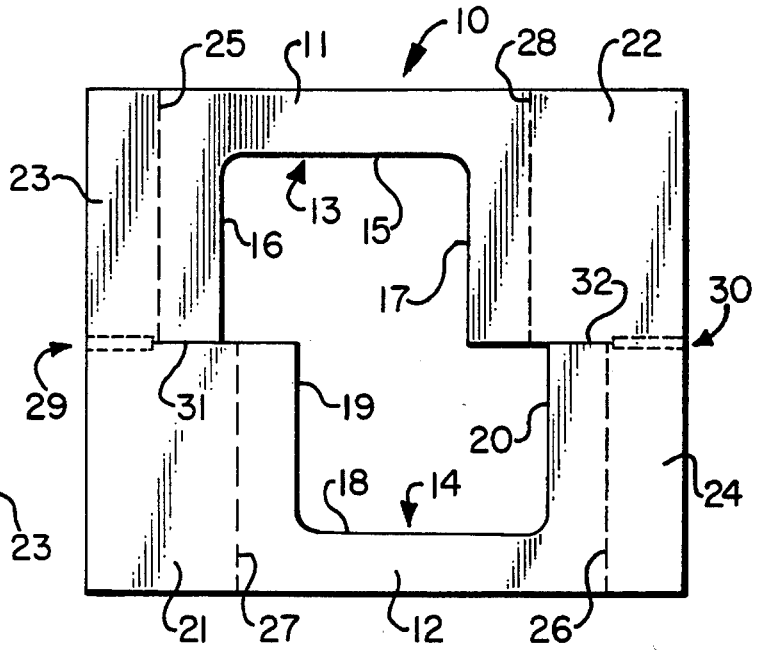
FIG. 1 is a plan view of a typical cut and scored blank useful for making the partition element of the present invention.

An exemplary blank for the partition element of the present invention is denoted by reference character 10 in FIG. 1, and is formed from a single generally rectangularly shaped cut and scored sheet of corrugated paperboard or the like. The corrugations are arranged to extend from top-to-bottom of the formed partition element shown in FIG. 2. An example of a typical partition element is shown for example in U.S. Pat. No. 4,320,867.

Meanwhile, referring once again to the structure of FIG. 1, blank 10 may be seen to comprise a pair of primary divider panels 11 and 12, each having foldably attached to one end thereof a pair of secondary support panels 21 and 22, along fold lines 27 and 28 respectively. At the opposite ends of panels 11 and 12, there are a pair of reinforcing panels 23 and 24 foldably attached thereto along fold lines 25 and 26 respectively.

Each of the primary divider panels are provided with generally U-shaped cut outs 13, 14 formed by cut lines 15, 16, 17 and 18, 19, 20. In blank form, the U-shaped cut-outs are offset from one another so that one end of primary panel 11 is separated from secondary panel 21 by cut line 31, and one end of primary panel 12 is separated from secondary panel 22 by cut line 32. Meanwhile, the secondary panel 21 remains foldably attached to reinforcing panel 23 by a pair of double score lines 29, and the secondary panel 22 remains foldably attached to reinforcing panel 24 by a pair of double score lines 30. When the blank 10 of FIG. 1 is folded about double score lines 29 and 30, and secondary support panel 21 is folded in one direction about score line 27, while secondary support panel 22 is folded in the opposite direction about score line 28, a generally Z-shaped configuration is achieved with two divider panels 11 and 12 as shown in FIG. 2.

Figure 2:
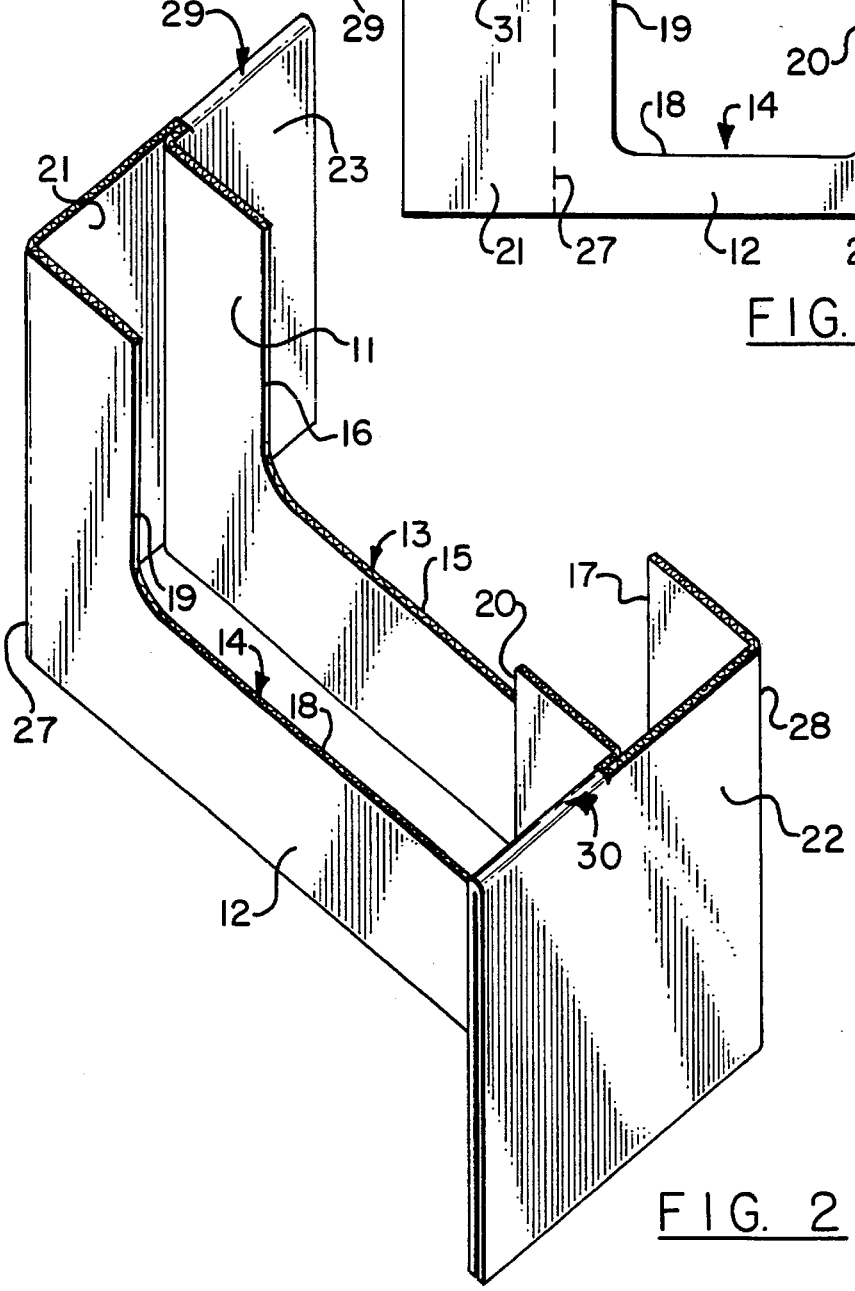
FIG. 2 is an isometric view of the partition structure formed from the blank of FIG. 1.

With the blank folded as shown in FIG. 2, an interior partition element is formed wherein the primary divider panels 11 and 12, which include cut-outs 13 and 14, are perpendicularly oriented with respect to the secondary support panels 21, 22. When the partition thus formed is inserted into an outer container as shown in FIG. 3, the primary divider panels 11 and 12 are generally oriented from side-to-side to form three separate loading cells while the secondary support panels 21 and 22 lie adjacent to and in contact with the side walls of the outer container to provide added reinforcement for withstanding stacking loads.

Figure 3:
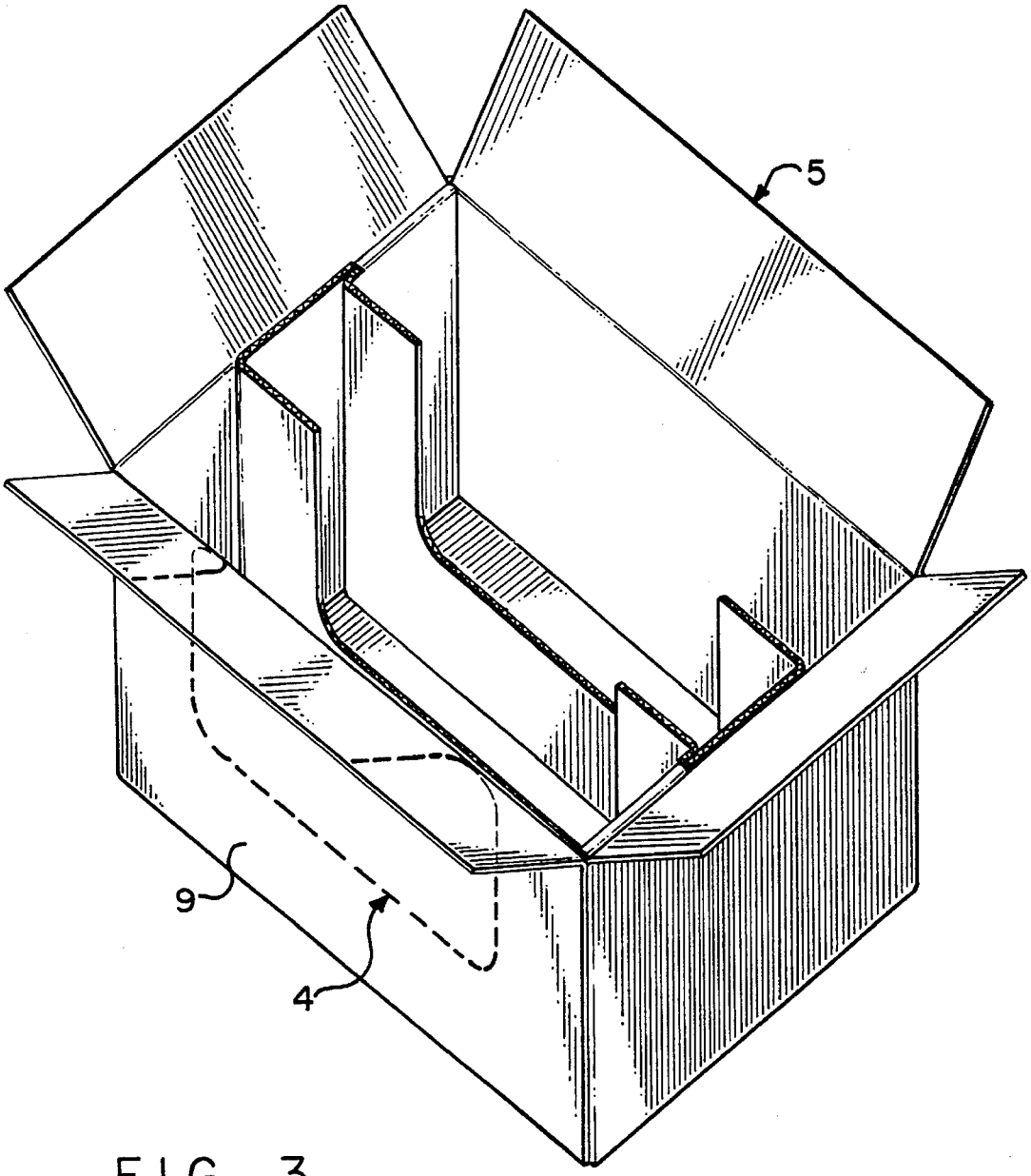
FIG. 3 is an isometric view showing the partition structure of FIG. 2 inserted in an outer container.

A preferred example of the outer container 5 shown in FIG. 3 has a front wall 9 that includes a perforation line 4 which defines a U-shaped cut-out, known in the industry as a TV window. The U-shaped cut-out defined by perforation line 4 is of generally the same shape and size as the cut-outs 13 and 14 in primary divider panels 11 and 12, respectively. However, if desired, to facilitate loading of the outer container, the heights of the cut-outs 13 and 14 along cut lines 15, 18 may be staggered from front-to-back, and the widths of the sides of the cut-outs 13, 14 along cut lines 16, 17 and 19, 20 may be staggered front-to-back. The objective of such modifications would be to provide TV-like windows in each divider panel 11, 12 of slightly different size to permit substantially unrestricted view of the packaged articles in the display mode of the shipping and display carton while improving the loading capabilities of the carton and increasing stacking strength.

After the carton is loaded with filled articles, it is sealed closed for shipping substantially as shown in FIG. 4. In this condition, the interior partition element provides adequate support for stacking and for withstanding normal shipping and handling stresses.

When the carton reaches its destination, the top closure flaps of the outer container may be removed and the front panel cut out may be formed by breaking the line of perforations 4 to produce the aforementioned TV window. This provides a useful and attractive display format particularly as shown in FIG. 5. Because of the compatible construction of the outer container and the divider panels of the partition element, the articles contained in the carton are immediately exposed for display at the point of sale while readily permitting removal of individual articles as desired by consumers.

Thus there has been described herein a preferred embodiment of a shipping and display carton together with a method for using the carton in packaging, shipping and display of a plurality of articles. However, since numerous modifications and variations will be possible by those skilled in the art, the scope of the invention is to be defined only by the following claims which are exemplary of the invention.

What is claimed is:

1. A convertible shipping and display carton comprising a generally rectangularly shaped outer container forming a shipping enclosure for a plurality of articles, and a generally Z-shaped interior partition element having at least two primary divider panels, for dividing said outer container into a plurality of loading cells, the improvement wherein each of the front wall of the outer container, and the divider panels of the partition element include compatibly shaped cut-outs which provide a substantially unrestricted view of the packaged articles when the carton is converted to display.

2. The carton of claim 1 wherein the cut-out in the front wall of the outer container is formed by a line of perforations arranged centrally therein of generally U-shape wherein the lower leg of the cut-out is positioned at a designated height from the bottom of the front panel and the two vertical legs of the cut-out are spaced equidistantly from the two sides of the front panel.

3. The carton of claim 2 wherein the cut-outs in each divider panel are arranged centrally therein and are generally U-shaped wherein the lower legs of the divider panel cut-outs in each case are positioned at about the same height as the lower leg of the cut-out in the front panel of the outer container, and the two vertical legs of the cut-outs in each divider panel are spaced equidistantly from the sides of each divider panel at about the same distance as the two vertical legs of the cut-out in the front panel of the outer container.

4. The carton of claim 3 wherein the partition element further includes a first support panel foldably attached to one end of one divider panel and a second support panel foldably attached to the opposite end of another divider panel.

5. The carton of claim 4 wherein a first reinforcing panel is foldably attached to the opposite end of said one divider panel and a second reinforcing panel is foldably attached to the opposite end of said other divider panel.

6. The carton of claim 5 wherein the primary divider panels of the partition element are arranged to extend from side-to-side within the outer container.

7. The carton of claim 6 wherein the secondary support panels of the partition element are arranged to lie adjacent to and in contact with the side walls of the outer container.

8. The carton of claim 7 wherein the reinforcing panels are further foldably attached to the secondary panels so as to lie adjacent to and in contact with the secondary panels within the outer container.

9. The carton of claim 8 wherein the heights of the cut-out in the front wall of the outer container and the cut-outs in each divider panel may be staggered front-to-back.

10. The carton of claim 9 wherein the location of the vertical legs in the cut-out in the front wall of the outer container and in each divider panel may be staggered front-to-back with respect to the side edges of the front panel and the divider panels respectively.

* * * * *